United States Patent [19]

Sutter et al.

[11] Patent Number: 4,490,949

[45] Date of Patent: Jan. 1, 1985

[54] BENCH TYPE SEATING MODULES

[75] Inventors: David L. Sutter, Kennebunkport; Ivan J. Furbish, Sanford; Roland C. Ferguson, Biddeford, all of Me.; Richard L. Berry, Milton Mills, N.H.; Douglas P. Barrows, Acton, Me.

[73] Assignee: Hussey Manufacturing Company, North Berwick, Me.

[21] Appl. No.: 434,731

[22] Filed: Oct. 18, 1982

[51] Int. Cl.[3] ..... E04H 3/12

[52] U.S. Cl. ..... 52/9; 52/183

[58] Field of Search ..... 52/6, 8, 9, 10, 182, 52/183; 108/901; 297/DIG. 2, 443, 448, 452

[56] References Cited

U.S. PATENT DOCUMENTS

| | | | |
|---|---|---|---|
| 1,978,494 | 10/1934 | Junkers | 297/422 |
| 2,970,638 | 2/1961 | Halter | 297/460 |
| 3,012,818 | 12/1961 | Brown | 297/248 |
| 3,298,045 | 1/1967 | Anderson | 297/452 |
| 3,397,011 | 8/1968 | Sklaar | 297/219 |
| 3,438,164 | 4/1969 | Duepree | 108/910 |
| 3,466,087 | 9/1969 | Motter | 297/232 |
| 3,531,157 | 9/1970 | Duckett et al. | 297/219 |
| 3,669,497 | 6/1972 | Massonnet | 297/248 |
| 3,761,130 | 9/1973 | Suzuki et al. | 297/DIG. 2 |

*Primary Examiner*—James L. Ridgill, Jr.
*Attorney, Agent, or Firm*—Robert B. Russell

[57] ABSTRACT

A molded plastic seating module is disclosed which is suitable for assembly in groups to form bench type row seating especially telescoping bleachers. Each module is hollow and comprises two sections, a contoured seat and an upstanding base. The base is adapted to be secured to the support structure both vertically and horizontally and to resist tipping and the presence of structural stress concentrations in use. The seat is adapted to engage the base in a snap fit relation along its front and rear walls.

8 Claims, 10 Drawing Figures

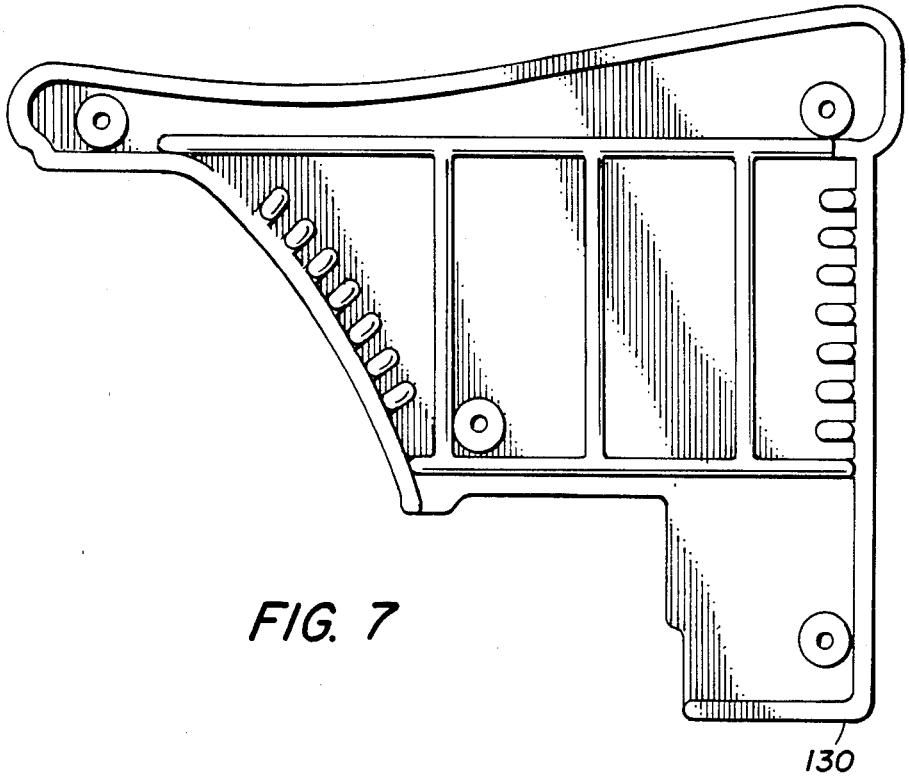
FIG. 7
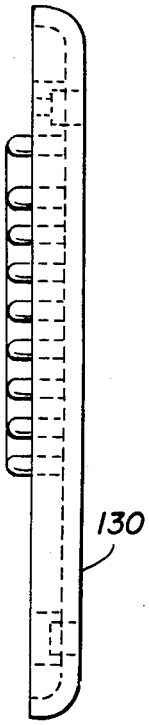
FIG. 8
FIG. 10
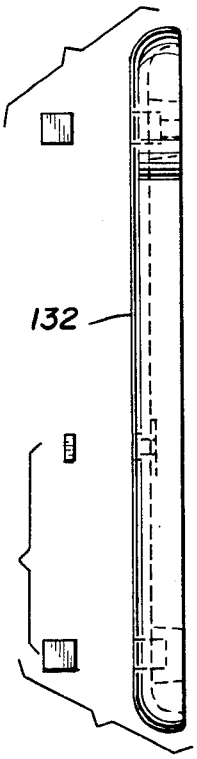
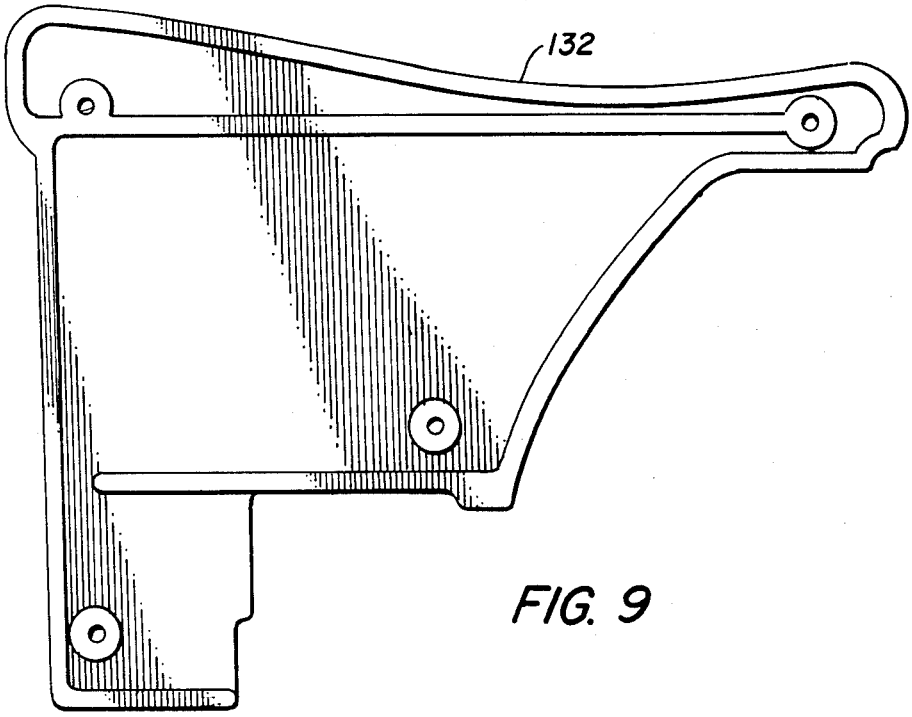
FIG. 9

BENCH TYPE SEATING MODULES

FIELD OF THE INVENTION

The present invention relates generally to seating for bleachers, stadiums, and the like especially telescoping bleachers. More particularly, the present invention relates to molded plastic seating modules suitable for assembly as bench type row seating upon various support structures.

BACKGROUND OF THE INVENTION

Traditional telescoping bleachers comprise long rows of wooden planks affixed to upstanding leg elements attached to various types of supporting structures. Not only is such seating notoriously uncomfortable, but also it is susceptible to wear, splintering, water soaking, rot, oxidation of fastening elements, and vandalism. The substitution of formed sheet metal of a weather resistant type such as aluminum or galvanized steel for the wooden planks has alleviated some of these problems but at far greater expense and with the introduction of new problems. Thus, metal planking remains uncomfortable, and while it is not as subject to wear, splintering and rot as wood, it is subject to denting, cracking, and expansion and contraction with temperature and vandalism.

Numerous attempts to solve some or all of these problems have been made with varying degrees of success. For example, it has been suggested to cover the wooden planks with cushioning material and to then cover the cushioning material with a heavy, tough plastic cover. Covering the planks with molded plastic elements without cushioning therebetween has also been suggested (U.S. Pat. No. 3,397,011). These suggestions helped preserve the wood, but they did not provide solutions to the other problems. Molding plastic covered seats as individual modular units, with each unit designed to accommodate a single person, and attaching them side by side to each other or to a base to form a continuous row of seats has also been suggested. (U.S. Pat. Nos. 3,012,818, 3,466,087). Such constructions satisfy the need for regular demarcation of assigned seats, but they are expensive and difficult to install. Other prior suggestions include providing stamped metal or molded plastic portable modular seat units adapted to being placed over conventional seating and having a compound curved shape for improved comfort. (U.S. Pat. Nos. 2,970,638, 3,466,087). In addition various ways to connect such individual seating modules to each other and/or to a base to form continuous rows thereof have been suggested including the use of (a) attaching flanges bolted or soldered together (U.S. Pat. No. 1,978,494); (b) tie bolts (U.S. Pat. No. 3,012,818); (c) separate connecting members which fit over and clamp the adjacent ends of the modules (U.S. Pat. No. 3,466,087); (d) screws or bolts (including "tamper proof" heads) through the front walls or underneath surfaces of the modules (U.S. Pat. Nos. 3,298,045, 3,397,011, 3,531,157), or through the clamping members (U.S. Pat. No. 3,466,087).

While some of these suggestions have provided the desired comfort, and others have adequately protected the underlying base, they have all been relatively expensive to construct and install, and none has provided completely hidden fasteners as distinguished from exposed "tamper proof" bolt or screw heads.

More recently it has been suggested that hollow, molded polymeric structural foam seating modules be assembled together to form the entire bench portion of the seating assembly rather than as a protection or substitute for the traditional wooden planking. Such constructions have successfully dealt with some of the problems facing the seating industry. For example, structural foam is very durable, it is relatively inert, it resists ultra-violet, denting, cutting and burning; it is light-weight; it can easily be tinted or colored throughout rather than merely on the surface; it can be given a textured surface for improved appearance as well as to improve resistance to slippage or dirt; it can be easily manufactured into substantially any desired shape or configuration at comparatively low cost.

In spite of these advantages of the material, the constructions employed have not been highly successful. The modules, for instance, have been molded as single, integral units presumably for reasons of strength, durability, and the avoidance of unauthorized disassembly by vandals. This mode of construction, however, entails high manufacturing costs, results in bulky articles which are expensive to store and ship because they cannot be nested and it also makes on site assembly and/or replacement difficult if hidden, tamper-proof fastenings are used. Similarly, in an effort to maximize foot room for the seat occupant and for the row behind while at the same time providing a comfortable molded seat, presently available seating of this type is of a generally triangular cross section. As a consequence, the base portion of such modular seating where the module is affixed to the support structure is comparatively narrow at the very point where the tipping forces encountered in use will induce the greatest structural stress. While molded structural foam has many attractive physical properties, the fact remains that it is still plastic and relatively weak compared to steel. Therefore, any construction employing it which concentrates bending stress at a narrow point will be prone to failure. As a result, the previously known seating modules employing structural foam required the addition of a metal reinforced base which was expensive in the manufacture and/or installation of the seating. In addition, the unitary modular construction of such seating prevented the modules from telescoping one into the other for space saving during shipment and storage. Additionally, in the context of nesting or telescoping bleachers the front edges of the seats of the currently available plastic seat modules project forwardly so that when the bleachers are stowed the front edges provide a ladder-like foothold for persons wishing to climb the structure. This is undesirable especially when such bleachers are installed in school gymnasiums and the like. The potential for damage to the bleachers and for liability for personal injury resulting from falls which may occur from such misuse of these structures are distinct disadvantages.

Replacement of damaged modules is also a problem. Currently available systems require the replacement of an entire module when any part of it is damaged. Also, the disassembly or removal of more than one module may be required, when only one module may be damaged and thereby unnecessary extra cost is incurred.

Accordingly, it is an object of this invention to provide a novel, hollow, molded structural foam seating module which solves the problems discussed.

BRIEF DESCRIPTION OF THE INVENTION

These and other objects and advantages of the present invention are accomplished by the provision of a novel two part seating module having a new design as will hereinafter more fully appear. Prior to this invention it was thought that a single, unitary, integral structure was necessary in order to insure a sufficiently strong, durable, and vandal-proof construction. We have found, however, that modules of superior design may be constructed in two joinable parts, namely, a molded seat portion and a hollow base portion, without sacrificing strength, durability, or vandal-proofness. In fact, the two part modules as more specifically designed and described herein are easier to manufacture and install, less cumberson and expensive to store and ship, and less susceptable to tipping and stress concentrations from applied forces in use than presently available products of this type.

Generally speaking the modules consist of molded base and seat portions. The base portion is an integrally molded piece having a bottom wall, an upstanding rear wall, and an upstanding end wall at one end adapted to lock into the open opposite end of an identical second base portion, a front wall to extend above the bottom wall a height equal to that of the rear wall and also extending below the bottom wall, along the front of the base. Reinforcing structural ribs are disposed both within the cavity formed by the base portion and also between the front wall and the lower surface of the bottom wall of the base portion. Adjacent and parallel to the top of each of the front and rear walls projecting outwardly from the outside surfaces thereof is a horizontal ridge or bead integrally molded as part of the base portion.

The molded seat portion comprises a single integrally molded element including a horizontal top wall contoured for seating comfort, a downwardly extending a pair of side end walls, front and rear walls each forming a shallow inverted cavity. In the inverted cavities of both the front and rear walls there is a horizontal groove adjacent and parallel to its lower edge in the interior thereof which, when the module is assembled, will mate with the ridges on the outer surfaces of the front and rear walls of the base portion. The seat portion also includes integrally molded reinforcing ribs in the cavity formed by the top, end, front and rear walls according to the design criteria chosen.

It is significant to note as well that the module of the present invention further employs an enlarged pedestal portion the fore-and-aft dimension of which is on the order of one-half of the fore-and-aft dimension of the seat portion. This provides a relatively wide support area whereby the stress of forces applied to the margins of the seat portion are distributed over a relatively wide pedestal support area within the plastic elements. The base portion is preferrably mounted on a multiflanged channel which is bolted to the bleacher support structure with the pedestal portion of the base member of the module being secured over an extended area to two or more flanges of the channel. In this way, the bending forces between the module and the channel are distributed over a wide area, but concentrated in the metal of flanged channel on which it is mounted. Mounting brackets and expansion rivets are utilized which secure the seating module to the channel against both vertical tipping and horizontal forces.

The base portions of the modules are formed in an essentially hollow inverted trapazoidal box-like configuration having one end open and having the front and rear walls reinforced by shallow vertical ribs. This permits the base portions to be secured to the mounting channel by upstanding bolts, fitting through the base pedestal, which may easily be tightened from above prior to fitting the seat portions onto the base portions. This hollow cavity arrangement also permits shipping the base portions in telescoping, stacked relationship thereby saving space. Base modules of this construction can be individually removed and replaced without disrupting an entire row, and, if damaged, only one portion of the module need be replaced.

The seat portions are attached simply by pressing them down onto the upstanding front and rear walls of the base portions, with the horizontally prominent beads on the front and rear walls snapping into the grooves within the slots in the mating front and rear walls of the seat portions. Although this is merely a "snap fit", since it is made with stiff walls of structural foam, it provides an extremely strong lock fit which effectively deters tampering. The seat portions can, of course, be removed by a person who is equipped with an appropriately shaped and dimensioned hook-lever tool, but such a tool is not commonly available, and the seat modules of this construction have been found to be effectively tamper-proof. Also since the attaching bolts for the base portions are hidden and the modules interlock, nothing is exposed for unauthorized detachment. At the ends of the respective rows of modules end caps are provided and attached to the modules by screws, the heads of which are recessed and covered with tightly fitting flush plugs. In this way no head of any fastener is exposed.

Since the supporting pedestal of the base portions is relatively wide (in the fore-and-aft direction), and the support channel to which it is attached extends forwardly, the front wall of the base portion can be essentially vertical and directly below the front edges of the seat. This is an important feature because it assures that, when the modules are used for telescoping bleachers adapted to be stowed in a completely nested state, the front wall of the stowed bleacher combination is essentially flat, without any convenient toe-holds for an unauthorized person to use should he be inclined to climb up onto the structure. In addition, because of this flat condition, the lower face of the module can be extended downwardly by attaching additional spacers thereto, to accommodate different rise dimensions, while still preserving the totally closed, flat condition of the assembly in the closed or stowed state.

BRIEF DESCRIPTION OF THE DRAWINGS

These and other features, objects, and advantages of the present invention will be understood by those skilled in the art from the following detailed description of a preferred embodiment of the present invention and from reference to the accompanying drawings in which:

FIG. 7 is a side elevational view of a right end cap for use with the seating module shown in FIG. 4;

FIG. 8 is a front elevational view of the right end cap shown in FIG. 7;

FIG. 9 is a right side elevational view of a left end cap for use with the seating module shown in FIG. 4;

FIG. 10 is a front elevational view of the left end cap shown in FIG. 9.

DETAILED DESCRIPTION OF PREFERRED EMBODIMENT

Figure 2:
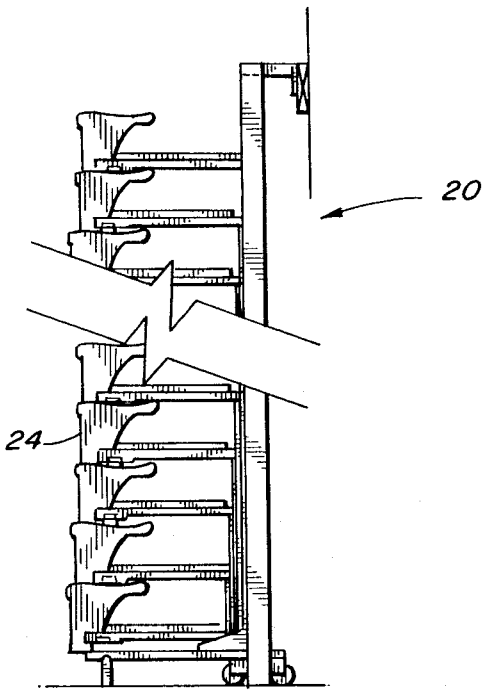
FIG. 2 is a view in side elevation of the grandstand of FIG. 1 in the retracted or closed position.
Figure 1:
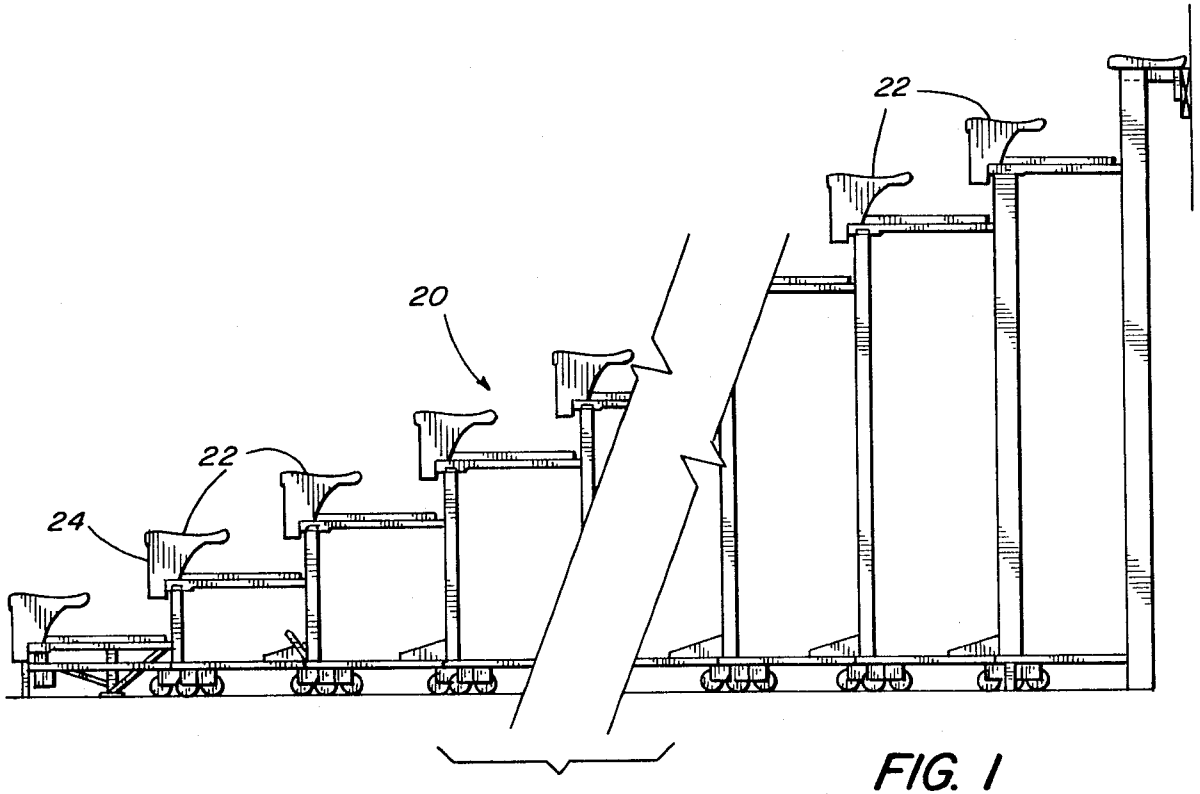
FIG. 1 is a diagrammatic view in side elevation, partially broken away, of a nesting (or telescoping) grandstand in the open (or "use") position upon which rows of seating modules in accordance with the present invention have been assembled and mounted.
Figure 3:
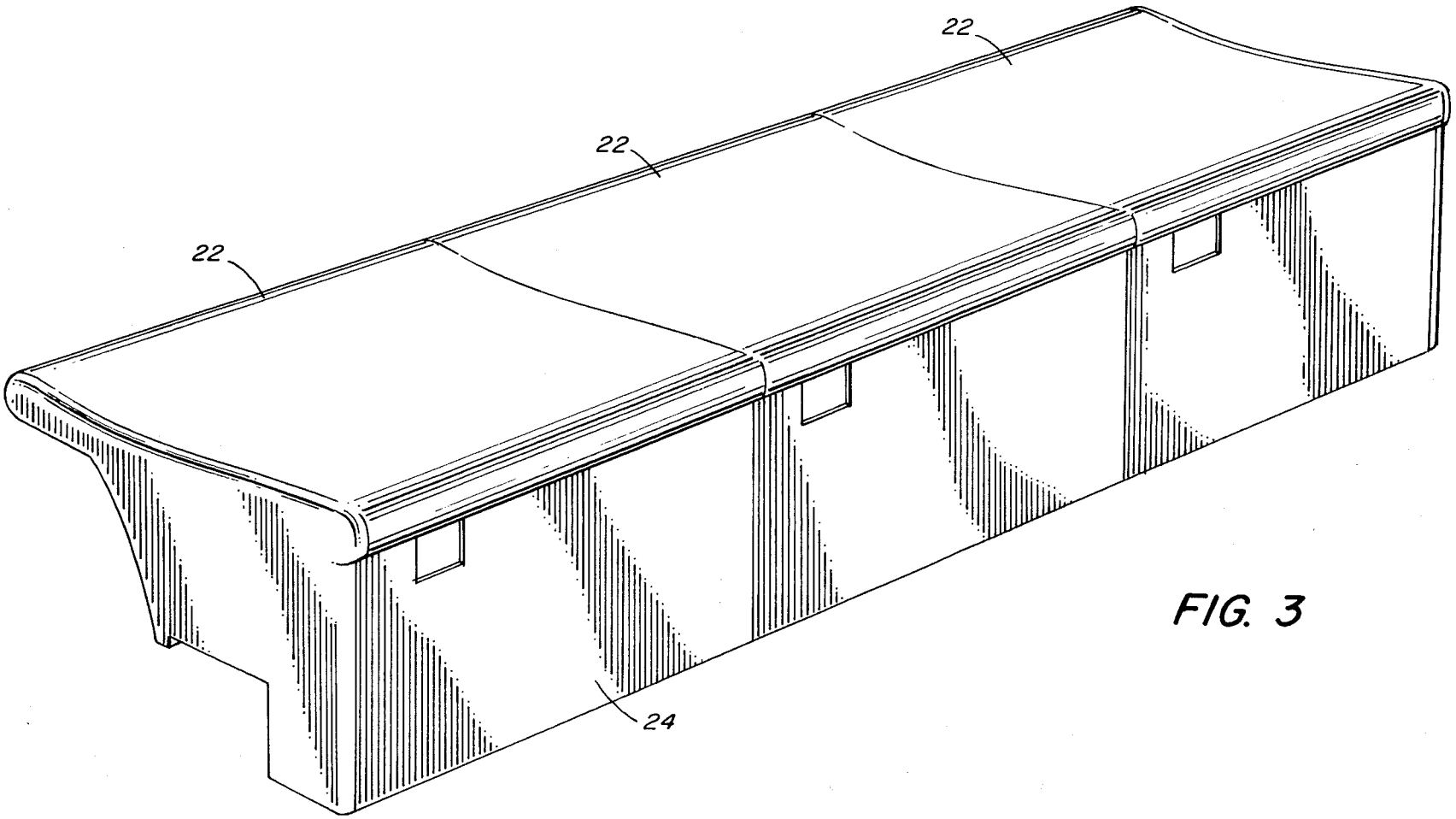
FIG. 3 is a diagrammatic perspective view of an assembly of three modular seating units in accordance with the present invention.

Referring now specifically to the drawings, in which like reference numerals are used to indicate like elements throughout, FIGS. 1 and 2 show diagrammatically a nesting or telescoping bleacher generally indicated at 20 of the heretofore well known type, in the open, set-up configuration and in the closed configuration respectively. The seating modules 22 in accordance with the present invention are assembled in rows as shown in FIG. 3 and affixed to the bleacher structure at the locations shown in these figures. It will be understood that while this type of bleacher has been selected for the illustrative purposes of this description, the use of this invention is not to be construed as being limited to this context. It is contemplated that the present invention can be adapted for use with substantially any support structure commonly utilized in grandstands, stadiums, amphitheaters and the like. Telescoping bleachers are in widespread use and it is believed that they constitute the largest market for the present invention. In fact, it is for this reason, among others which will become apparent below, that the present invention includes a substantially vertical front face 24 to inhibit climbing of the stowed bleacher as shown in FIG. 2.

Each module of the present invention comprises two parts, a molded contoured seat portion indicated generally at 26 and a base portion indicated generally at 28. These elements are molded from extremely tough, strong, durable, and inert, polymeric thermoplastic structural foam or the like material. This material which has an integral skin, a cellular core, and a strength-to-weight ratio adequate to give it an excellent structural rating, has been known in this industry as being effective in the present context because it may readily be molded. As has been alluded to above, this material can be made in a wide variety of attractive colors, and can be given any desired matte, or simulated grain surface. It is stain resistant, impervious to and does not absorb moisture, and it is easily cleaned. Also, it is scratch and dent resistant, extremely difficult to carve, will not sustain combustion under normal ambient conditions and is resistant to ultra-violet rays. It has not, however, been used with complete success due to structural shortcomings and difficulties in molding and assembly.

Figure 4:
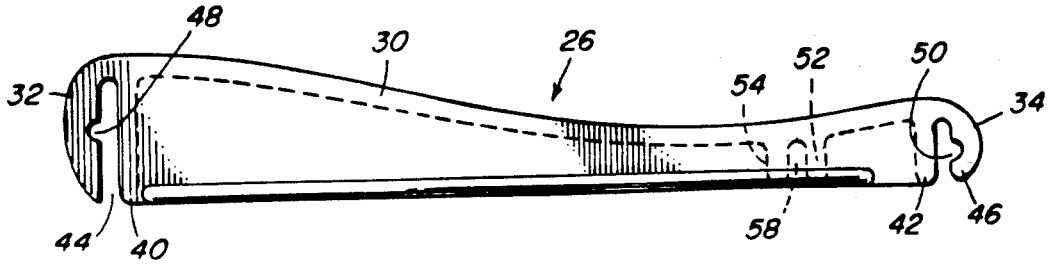
FIG. 4 is an exploded right side elevational view of the parts of a representative seating module in accordance with the present invention showing a preferred mounting means for connecting the base portion of the module to an underlying support structure and the seat portion of the module separated from the base portion.
Figure 4:
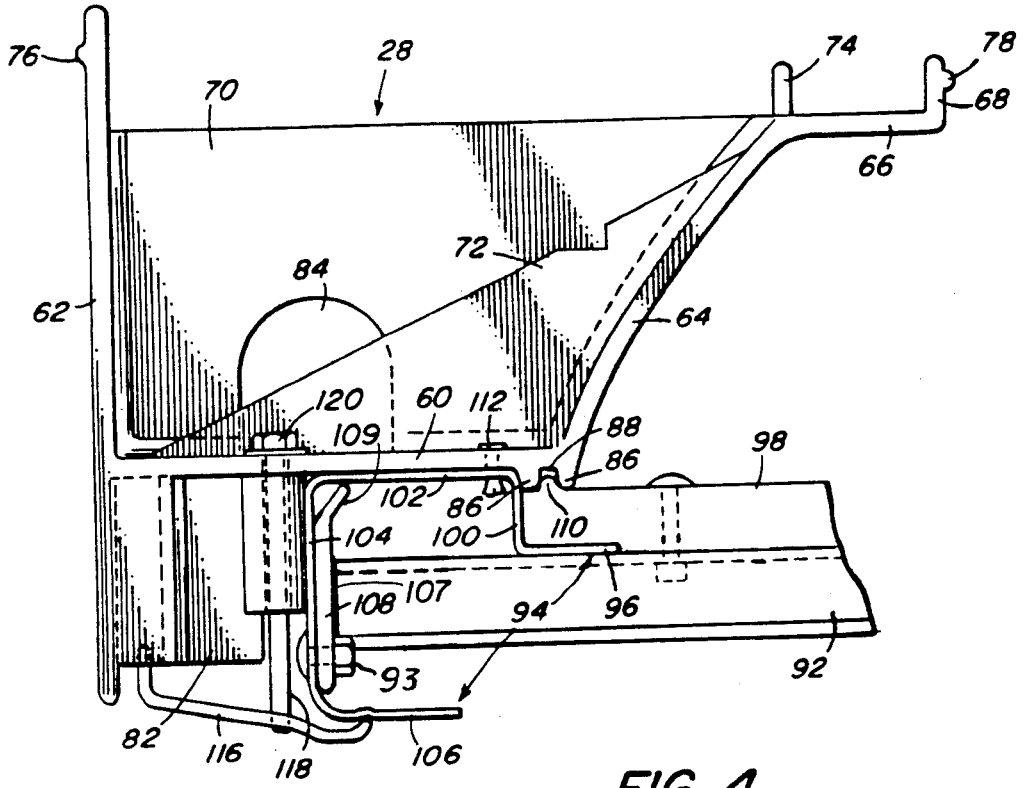
Figure 6:
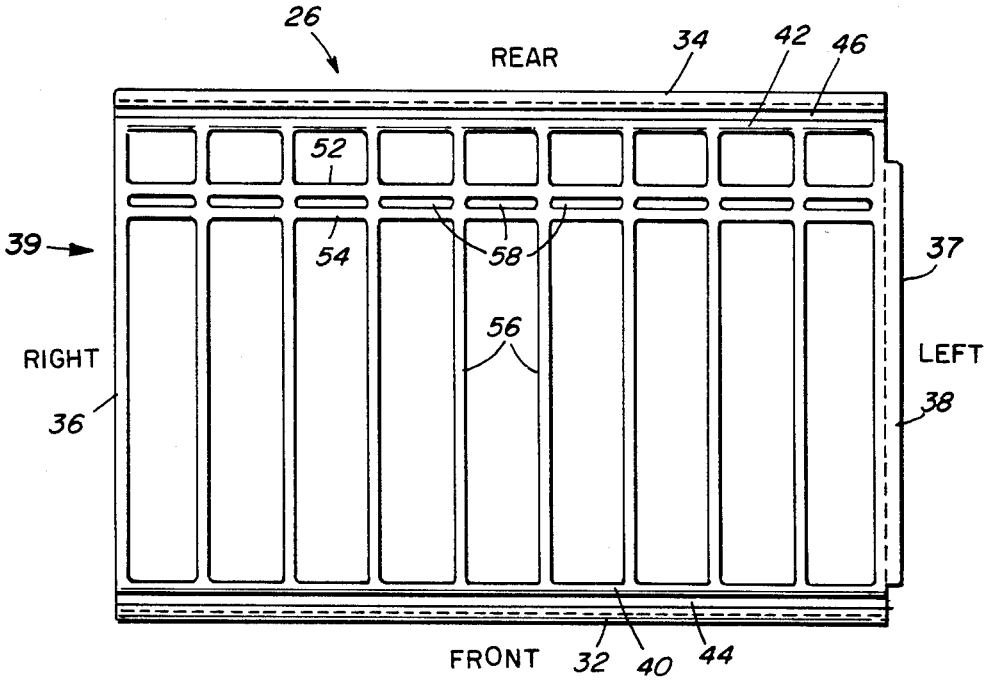
FIG. 6 is a plan view from below of the seat portion of the module shown in FIG. 4.

The two parts of the seating module construction of the present invention, are shown in exploded relation together with a representative mounting means in FIG. 4 adapted for on site interlocking assembly. Specifically, the molded, contoured seat portion 26 is of generally flat rectangular shape having a top surface 30 the upper surface of which is contoured as desired for user comfort. Extending downwardly from the edges of top 30 and integral therewith are a front wall 32 and a rear wall 34 and right and left side walls 36 and 38, respectively. (See FIG. 6.) The corners of front wall 32 and rear wall 34 are contoured for comfort of the seat occupant. Spaced inwardly from front and rear walls 32 and 34 are parallel walls 40 and 42 respectively forming narrow slots 44 and 46, respectively. Also, within slots 44 and 46, the inner surfaces of walls 32 and 34 respectively are provided with locking grooves 48 and 50, respectively. Grooves 48 and 50 run the entire length of front and rear walls 32 and 34, respectively. Further, as may be seen in FIG. 6, seat portion 26 also includes longitudinally extending (along the axis of the seat row) reinforcing ribs 52, and 54 and transverse reinforcing ribs 56. The ribs 52, 54, 56 extend downwardly from the top 30 and are integral therewith, with each other and with side walls and between ribs 52 and 54 they define a series of cavities 58 extending across the underneath of seat portion 26. The purpose of cavities 58 is for positioning when the seat portion 26 is affixed to the base portion 28.

Finally, it should be noted that right and left side walls 36 and 38 of seat portion 26 are adapted for interlocking engagement with seat portions of adjacent modules or with appropriate end caps 130 and 132 shown in FIGS. 7–10. For this purpose, left side wall 38 is provided with a projection 37 and right wall 36 is recessed as indicated at 39 correspondingly so as to interlock when modules are arranged in side-by-side abutting relation.

Figure 5:
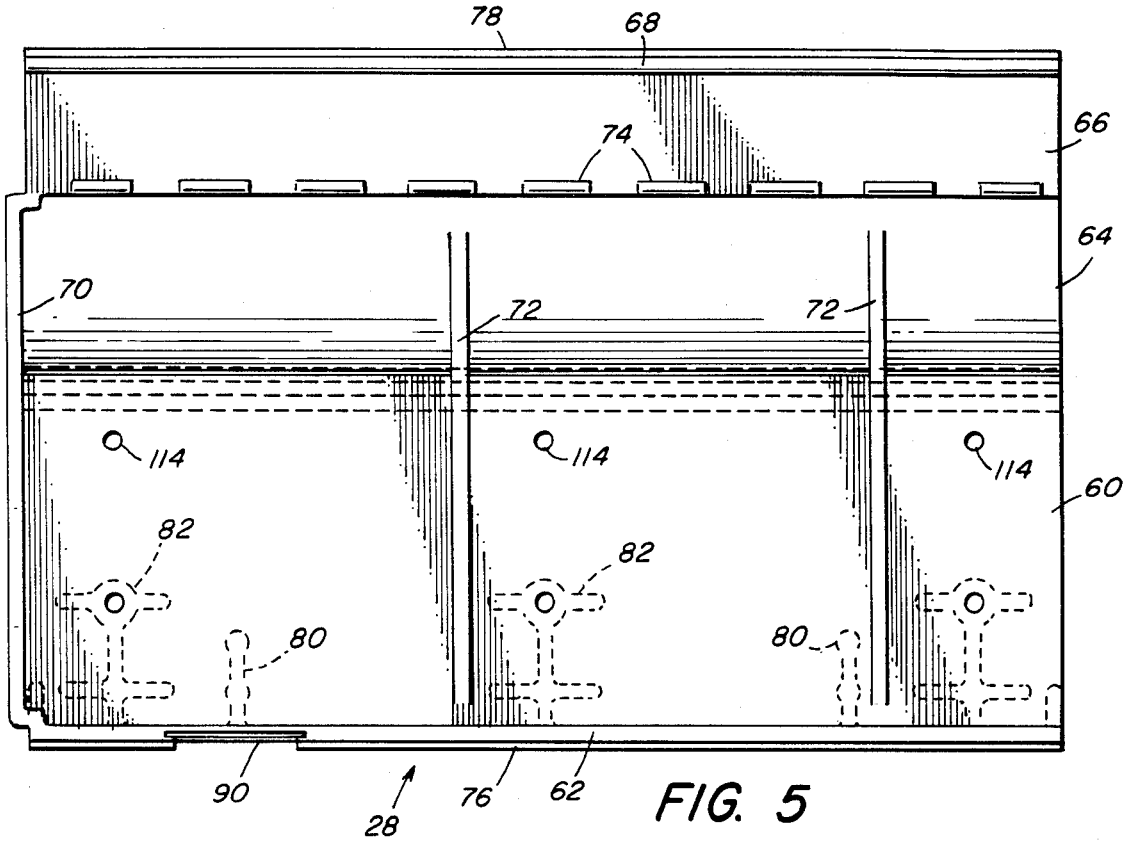
FIG. 5 is a plan view from above of the base portion of the seating module shown in FIG. 4.

Turning now to base portion 28 as shown in FIGS. 4 and 5, it will be seen that the unit basically comprises a support pedestal or bottom wall 60; a substantially vertical front wall 62 integral with bottom wall 60 and extending both above and below it; a rear wall 64 integral with support pedestal or bottom wall 60 extends upwardly and rearwardly in a curved arc to a flat horizontal portion 66 and terminates with an upstanding vertical rear wall 68. In addition, a left hand (when viewed from the front) end wall 70 is provided extending upwardly from the bottom wall 60 and integral also with the front and rear walls 62 and 64. The dimension below bottom wall 60 to which front wall 62 extends depends upon the rise dimension of the seats and is selected to provide an enclosed, flat, vertical front face when the bleacher is stowed. A separate extension can be provided for this purpose together with attaching means. The components of the base portion 28 form an essentially hollow, inverted trapezoidal, box-like structure having its top and one end open. Internal struts 72, integrally molded with the rest of the unit, reinforce curved rear wall 64. A series of substantially vertical, spaced, upstanding projections 74 rise from the junction of curved wall 64 and flat portion 66. Projections 74 are constructed and arranged to fit into cavities 58 in seat portions 26. Along the upper outer margins of front wall 62 and vertical rear wall 68 are provided horizontally projecting molded beads 76 and 78, respectively. Beads 76 and 78 run the entire length of the base portion 78 parallel to the upper edges of walls 62 and 68, respectively and are so positioned as to engage in grooves 48 and 52 in seat portion 26 when walls 62 and 68 are inserted into slots 44 and 40 of seat portion 26.

Stiffeners 80 and stiffening hardware receiving elements 82 (see FIGS. 4 and 5) are molded into and integral with bottom wall 60 and front wall 62.

It is contemplated that the ends of the modules will interlock with each other or with appropriate end caps (see FIGS. 7 to 10). Accordingly, a portion of left end wall 38 is molded so as to project laterally to form an extension of substantially the same size and shape as the open right end of an adjacent base portion 28 and to fit therein in mating engagement or to fit into an end cap such as is shown in FIGS. 9 and 10.

Additionally, left wall 70 may be provided with a hole 84 for passage of electrical wiring through the assembled base portions 28 of an assembled bleacher for aisle lighting or other purposes. Also, the bottom wall 60 is provided with a pair of spaced beads 86 forming a groove 88 for mounting purposes as will be explained more fully below. Also the base portion 28 is provided with means for individual seat numbering comprising an open fronted slot 90 (see FIG. 5).

The molds for manufacturing seat portion 26 and base portion 28 are generally conventional with the exception of the method by which grooves 48 and 50 and beads 76 and 78 are formed. These elements are formed by means of removable cores. After molding, these cores are removed which, in turn, allows the molded elements to be removed from the mold.

The modules are mounted on forwardly extending z-section supports 92, by means of a longitudinally extending metal, essentially hollow multi-flanged channel 94 having a front flange 104 bolted to supports 92 through a plate 108 which is welded at 107 to the ends of supports 92. The channel 94 is generally rectangular in cross section and has a base flange 96, a flange 100 extending upwardly from base flange 96 to a height slightly greater than the thickness of a plank 98, a flange 102 extending forward horizontally, a flange 104 extending downward vertically, and a flange 106 extending back horizontally. The result is a generally squared-off J-configuration. The forward vertical flange 104 of channel 94 is attached by bolt 93 to plate 108 which is welded to support 92. The upper end of plate 108 is bent rearwardly at 109 and arranged to bear against the undersurface of flange 102 of channel 94 thereby further bracing the flange 102 against bending in response to tipping forces. The base portion 28 is secured to channel 94 with bottom wall 60 of base portion 28 resting on horizontal flange 102 with groove 88 in the undersurface of bottom wall 60 interlocking with an upstanding ridge 110 on plank 98 and with stiffeners 82 abutting flange 104 of channel 94. Expansion rivets 112 passing through holes 114 in bottom wall 60 and into flange 102 of channel 94 serve to anchor the rear of base portion 28 to the channel 94. A clamping bracket 116 is affixed to the underneath of the assembly by bolts 118 welded to brackets 116. Bolts 118 pass upwardly through elements 82 through bottom wall 60 when they are secured by nuts 120. Permissably, a metal plate may be disposed upon the upper surface of bottom wall 60 to provide a more secure pedestal for screws 112 and bolts 118. When nuts 120 are tightened, the brackets 116 bear against and hook under elements 82 adjacent to front wall 62 and also bear against and slightly indent the lower horizontal flange 106 of channel 94.

It will thus be seen that the base portion 28 is secured both vertically and horizontally and, by virtue of the width of the connection between the base portion 28 and channel 94 tipping forces applied to the module are spread over a wide area of the base of the plastic components. Flanges 102 and 104, which contact the plastic, cannot bend because of reenforcing plate 108 and the support of flange 96. This means that the plastic is protected against localized bending which might produce rupture and the full bending stress is concentrated in metal flanges 96 and 100 which are highly capable of withstanding same.

It should be noted that mounting the base portion 28 is accomplished without the seat portion 26 in place. This is significant because it permits convenient access to screws 112 and nuts 120 for attachment and tightening. This permits longer modules to be made with as many points of attachment as desired without creating a problem with respect to access to the fasteners.

Adjacent base portions 28 are similarly installed, the left wall of one interlocking with the right, open end of the next adjacent module as described above until a complete row is assembled. Seat portions 26 are next snap-fitted onto base portions 28 with the upper end of walls 62 and 68 fitting into grooves 44 and 46 and beads 76 and 78 locking into grooves 48 and 50, respectively. End cover portions 130, 132 (see FIGS. 7 to 10) are then applied and affixed by means screws in recessed cavities into which plugs are inserted over all fastening elements to complete the assembly.

In the fully assembled condition, no fastener heads are exposed and disassembly by unauthorized persons is extremely difficult. The snap-fit of the seat portions 26 onto base portions 28 is extremely tight due to the rigidity of structural foam. Disassembly can be accomplished by a person equipped with a pair of especially shaped and dimensioned hook-lever tools but such tools require a special design and are unlikely to be in the possession of or readily available to ordinary bleacher seat occupants. It is reasoned that parties who may be sufficiently intent upon destruction of the modules to obtain and learn how to use such special tools, could not be deterred from such destruction no matter how secure the lock might be. Therefore, the snap-fit of this invention is as effective a lock as can be provided.

The modules, however, can be readily disassembled by properly equipped service personnel for purposes of changing the seating arrangements or repair.

Since the modules comprise several parts, if any one part is damaged, only that part need be replaced rather than the entire module.

Since the base portions 28 are relatively hollow, and are provided in the form of inverted, trapezoidal boxes having an open top and one end open, they can be stacked one on top of the other in an essentially telescoping, nested relation. This saves substantial space in shipping and storing.

The dimensions of base portions 28 need not be high as shown, but can be of low profile and can be merely attached to conventional planking by screws. A major feature which makes these advantages possible is the snap-fit between the seat portion 10 and base portion 28 combined with the longitudinal (along the axis of the row of seats) interlock between modules (and the end components). In addition, the use of a mounting channel such as the J-sectioned component 302 which secures horizontally to the structural members of the bleacher and extends both forwardly and downwardly and back again permits the use of a broad connecting, pedestal or base for the plastic elements so as to minimize bending, in the plastic and thereby to spread the concentration of the bending stress in the plastic and transferring that stress to the underlying metal support structure which is fully capable of withstanding it. This support arrangement has two further advantages. First, it permits the use of a welded bracket element such as bracket 116 to securely clamp the module to the channel without leaving any exposed bolt or screwhead. Secondly, it permits filling the space directly below the front edge of the seat portion with an extension of front wall 62 of the base portion 28 of the module. This expands the area of contact between the base portion of the module, further distributing the concentration of bending stress in the plastic, and additionally providing for a substantially vertical front face 24 for the assembled modules whereby, when the bleacher rows are telescoped or nested into the stowed position, a substantially flush face 24 is presented without any ledges or projections upon which a person might attempt to climb up the stowed structure. If risers of different heights are employed, additional extensions can be added to the bottom of front wall 62. Also panels can be added extending longitudinally across aisles in line with front walls 62 but below the level of channels 94, to provide an enclosed aisle face when the bleachers are stowed.

Numerous variations and modifications of the present invention will now be apparent to those skilled in the art. For example, the invention may be adapted to curved row seating as well as straight rows. Cosmetic riser pieces molded of the same material may be added below the seating modules in cases where the linear height between seating rows differs from the standard. Further design modifications in the mounting system may be made which retain the benefits of vertical and horizontal securement, the distribution of tipping forces, and the reduction of stress concentration as above described. These and other variations and modifications of the principals of the embodiments discussed above come within the spirit and scope of the present invention and therefore, our intention is not to confine the invention to the precise form herein described and shown but rather to limit it in the terms of the appended claims.

We claim:

1. A molded plastic module for attachment to supporting structures for multiple seat rows, comprising a hollow base member made of molded polymeric structural foam having a bottom wall, upstanding front and rear walls, integral with said bottom wall, a first end wall integral with said bottom, front and rear walls at one end of said module, a molded seat of essentially equivalent material having front and rear slots positioned to receive the upper margins of said front and rear walls, a horizontal bead on each said front and rear walls parallel to their upper margins, a mating horizontal recess within said front and rear slots positioned to receive said beads in locking relation, and said seat mounted on said base with said beads locked into said recesses in said slots.

2. A molded plastic module and attachment combination for multiple seat rows, comprising a supporting structure, a hollow base member of molded polymeric material, a multiflanged metallic channel member having at least three flanges a first flange of which is secured to said supporting structure, and means for firmly securing said base member to at least two other flanges of said channel member whereby tipping forces applied to said module are distributed within said base member across said two other flanges and concentrated in said channel member in said first flange not in contact with said module.

3. A molded plastic module for attachment to supporting structures for multiple seat rows, comprising a hollow base member made of molded polymeric structural foam having a bottom wall, upstanding front and rear walls, integral with said bottom wall, a first end wall integral with said bottom, front and rear walls at one end of said module, a molded seat of essentially the same material having front and rear slots positioned to receive the upper margins of said front and rear walls, a horizontal bead on each said front and rear walls parallel to their upper margins, a mating horizontal recess within said front and rear slots positioned to receive said beads in locking relation whereby said seat is locked onto said base member, a channel member secured to said supporting structure and bracket means operable from within said base member for clamping said base member to said channel whereby said base member may be secured to said support while the cavity of said base member is open and the seat member can thereafter be snapfit onto said base member to render same substantially inaccessible to the operating element of said bracket means.

4. A molded plastic module for attachment to supporting structures for multiple seat rows, comprising a hollow base member made of molded polymeric structural foam having a bottom wall, upstanding front and rear walls, integral with said bottom wall, a first end wall integral with said bottom, front and rear walls at one end of said module, a molded seat of the same material having front and rear slots positioned to receive the upper margins of said front and rear walls, a horizontal bead on each said front and rear walls parallel to their upper margins, a mating horizontal recess within said front and rear slots positioned to receive said beads in locking relation whereby said seat is locked onto said base member, and means at said first end wall for interlocking with the opposite end of a second base member of identical construction in abutting and supporting relation with the front, rear and bottom walls thereof whereby the first end wall of the first base element serves as a second end wall of said second base element.

5. The module of any of claims 1, 2, 3 or 4 wherein the front wall is substantially vertical.

6. The module of any of claims 1, 2, 3, 4 or 5 together with a first and a second end cap, said first end cap adapted for interlocking with said first end wall to provide an aesthetically pleasing finished appearance thereto and said second end cap adapted to interlock with the opposite end of said module to provide an aesthetically pleasing finished second end wall to said module.

7. The module of any of claims 1, 2, 3, 4, 5 or 6 wherein said front wall extends below said bottom wall and wherein mounting means are provided for securing the bottom wall vertically in a horizontal position and for securing the front wall substantially horizontally in a vertical position whereby tipping forces are more evenly distributed and the module is more structurally integral with its underlying support.

8. The module of claim 5 further characterized by a separate extension for said front wall adapted to accommodate additional rise height between modules.

* * * * *